US007917061B2

(12) United States Patent
Min et al.

(10) Patent No.: US 7,917,061 B2
(45) Date of Patent: Mar. 29, 2011

(54) IMAGE FORMING APPARATUS

(75) Inventors: Hye Young Min, Suwon-si (KR); Moon Bae Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 4 days.

(21) Appl. No.: 12/564,432

(22) Filed: Sep. 22, 2009

(65) Prior Publication Data

US 2010/0119257 A1 May 13, 2010

(30) Foreign Application Priority Data

Nov. 12, 2008 (KR) ..... 10-2008-0112061

(51) Int. Cl.
*G03G 15/20* (2006.01)

(52) U.S. Cl. ..... 399/123

(58) Field of Classification Search ..... 399/107, 399/110, 111, 123, 343, 345, 350, 351
See application file for complete search history.

(56) References Cited

U.S. PATENT DOCUMENTS

| | | | | |
|---|---|---|---|---|
| 5,099,280 | A * | 3/1992 | Takemoto et al. | 399/123 |
| 6,917,774 | B2 * | 7/2005 | Terada et al. | 399/111 |
| 7,493,061 | B2 * | 2/2009 | Hatori et al. | 399/111 |
| 7,561,819 | B2 * | 7/2009 | Koizumi et al. | 399/101 |
| 2007/0196125 | A1 | 8/2007 | Koizumi et al. | |

FOREIGN PATENT DOCUMENTS

| | | |
|---|---|---|
| JP | 2007-219423 | 8/2007 |
| JP | 2007-219424 | 8/2007 |
| JP | 2007-219425 | 8/2007 |

OTHER PUBLICATIONS

English language abstract of JP 2007-219423, published Aug. 30, 2007.
Machine English language translation of JP 2007-219423, published Aug. 30, 2007.
English language abstract of JP 2007-219424, published Aug. 30, 2007.
Machine English language translation of JP 2007-219424, published Aug. 30, 2007.
English language abstract of JP 2007-219425, published Aug. 30, 2007.
Machine English language translation of JP 2007-219425, published Aug. 30, 2007.

* cited by examiner

*Primary Examiner* — Hoan Tran
(74) *Attorney, Agent, or Firm* — Staas & Halsey LLP

(57) ABSTRACT

Disclosed is an image forming apparatus with an improved structure for mounting or dismounting a cleaning device. An image forming unit includes an image carrier for transporting a developer image. A cleaning device includes a cleaning member to remove residual developer from the image carrier. The cleaning device is mounted or dismounted to/from the image forming unit by moving along a first direction and along a second direction. A first guide device includes a restraining unit to generally restrict movement of the cleaning device in the second direction when the cleaning device moves in the first direction, and a receiving unit to receive the restraining unit so as to allow the cleaning device to move in the second direction when desirable.

20 Claims, 12 Drawing Sheets

IMAGE FORMING APPARATUS

CROSS-REFERENCE TO RELATED APPLICATIONS

This application claims the benefit of Korean Patent Application No. 2008-0112061, filed on Nov. 12, 2008 in the Korean Intellectual Property Office, the disclosure of which is incorporated herein by reference in its entirety.

TECHNICAL FIELD

The present disclosure relates generally to an image forming apparatus, and, more particularly, to an image forming apparatus having a cleaning device to remove waste developer remaining on an image carrier.

BACKGROUND OF RELATED ART

An image forming apparatus refers to an apparatus that prints an image on a printing medium. Broadly speaking, an image forming apparatus can be classified as a printer, a copying machine, a fax machine, a multi-function printer which has multiple functions of printing, scanning, copying and faxing, or the like.

An electrophotographic type image forming apparatus refers to a type of image forming apparatus that is particularly widely used and uses developer, such as e.g., toner to develop an electrostatic latent image into visible image. By way of a brief description, in a typical electrophotographic type image forming apparatus, a light is scanned on a photosensitive body previously charged to a predetermined electric potential to form an electrostatic latent image on the surface of the photosensitive body, which electrostatic latent image is then developed with developer to form the visible image. The visible image formed on the photosensitive body may be directly transferred onto a printing medium, or in some cases may be transferred onto a printing medium via an intermediate transfer body. The image transferred onto the printing medium is fused to the printing medium through a fusing process to complete the image forming process.

In the image forming operations generally discussed above, the developer on the photosensitive body or the intermediate transfer body is not necessarily completely transferred onto the intermediate transfer body or the printing medium, and some portion of the developer may remain on the photosensitive body or the intermediate transfer body even after the transfer of the image. Such residual waste developer may be removed from the photosensitive body or the intermediate transfer body by the use of a cleaning device.

A cleaning device may include a cleaning member in frictional contact with a surface of the image carrier, such as, for example, a photosensitive body or an intermediate transfer body, to collect the residual developer on the surface of the image carrier.

The cleaning device may be replaceable, and to that end, may be provided so that it can be removed from the image forming apparatus.

SUMMARY OF THE DISCLOSURE

In accordance with one aspect of the present disclosure, there may be provided an image forming apparatus that may include an image carrier, a detachable cleaning device and a first guide. The image carrier may have a surface on which a quantity of developer is carried. The detachable cleaning device may be detachably supported in the image forming apparatus, and may include a cleaning member that is configured to come into contact with the surface of the image carrier so as to remove developer from the surface of the image carrier. The detachable cleaning device may be configured to move along a first direction and a second direction non-parallel to the first direction during mounting and dismounting of the detachable cleaning device to and from the image forming apparatus. The second direction may be a direction along which the cleaning member moves toward or away from the surface of the image carrier. The first guide may include a restraining portion and a receiving portion. The restraining portion may be configured to limit the movement of the detachable cleaning device along the second direction toward the surface of the image carrier when the detachable cleaning device moves along the first direction, the receiving portion being configured to receive the restraining portion so as to allow the detachable cleaning device to move in the second direction, the restraining portion and the receiving portion being adapted to cooperate together such that the movement of the detachable cleaning device along the first direction initiates the movement of the detachable cleaning device along the second direction.

The image forming apparatus may further comprise a second guide configured to guide the detachable cleaning device to mow along the second direction toward the surface of the image carrier so as to bring the cleaning member into contact with the surface of the image carrier.

The first guide may include at least one guide body provided at the detachable cleaning device and at least one guide rail. The at least one guide body may each have a guide surface extending along the first direction. The at least one guide rail may each have a side wall opposing the guide surface.

The first guide may further comprise at least one guide protrusion protruding along the second direction from any first ones of the guide surface and the side walls.

The first guide may further comprise at least one guide recess formed on a second ones of the guide surfaces and the side walls opposing the first ones of the guide surfaces and the side walls. The at least one guide recess may be configured to receive therein a respective corresponding one of the at least one guide protrusion.

The at least one guide protrusion may include a first guide protrusion and a second guide protrusion. The first guide protrusion may be arranged to be spaced apart from the second guide protrusion, and may be longer in length with respect to the first direction than the second guide protrusion.

At least one of the at least one guide protrusion and the at least one guide recess includes a slanted surface slanted with respect to the first direction, the slanted surface promoting the movement of the detachable cleaning device along the second direction.

The at least one guide protrusion may include a first guide protrusion and a second guide protrusion. The second guide protrusion may be located downstream of the first guide protrusion with respect to a mounting direction of the detachable cleaning device along the first direction. The mounting direction being a direction in which the detachable cleaning device moves while being mounted in the image forming unit. The at least one guide recess may include a first guide recess and a second guide recess respectively corresponding to the first guide protrusion and the second guide protrusion. The first guide protrusion may be longer in length with respect to the first direction than the second guide protrusion.

The at least one guide body may include a first guide body provided on the top portion of the detachable cleaning device and a second guide body provided on the bottom portion of the detachable cleaning device. The at least one guide rail may include a first guide rail and a second guide rail respectively corresponding to the first guide body and the second guide body.

The second guide device may include at least one mounting guide protruding from the front end portion of the detachable cleaning device along the first direction.

The second guide device may further include a guide frame disposed to oppose the front end portion of the detachable cleaning device when the detachable cleaning device is mounted in the image forming apparatus. The guide frame may include at least one guide channel to receive the at least one mounting guide in such a manner to guide the detachable cleaning device to move along the second direction.

The at least one guide channel may each include a position determination portion and a slanted portion slanted toward the position determination portion. The position determination portion may be in contact with a corresponding one of the at least one mounting guide when the detachable cleaning device is mounted in its proper mounting position within the image forming apparatus. The slanted portion may be arranged to guide the mounting guide to the position determination portion.

The image forming apparatus may further comprise a fixing unit to securely fix the detachable cleaning device to its proper mounting position within the image forming apparatus.

According to another aspect of the present disclosure, an image forming apparatus may be provided to include a transfer unit, a cleaning device, at least one guide body, at least one guide rail, at least one guide protrusion and at least one guide recess. The transfer unit may include a transfer belt configured to transfer developer onto a printing medium. The cleaning device may be removably mounted to the transfer unit, and may be movable along a first direction in relation to the transfer unit. The at least one guide body may be provided at the cleaning device, and may have a side surface extending along the first direction. The at least one guide rail may have a side wall that extends along the first direction, and that opposes the side surface of a corresponding one of the at least one guide body. The at least one guide protrusion may protrude from a first one or more surfaces selected from any of the side surfaces of the at least ore guide body and any of the side walls of the at least one guide rail. The at least one guide recess may be formed on a second one or more surfaces that oppose the first one or more surfaces, and may be adapted to receive a corresponding one of the at least one guide protrusion.

The at least one guide protrusion may each include a slanted surface non-parallel and non-perpendicular to the first one or more surfaces.

The guide recess may includes a slanted surface non-parallel and non-perpendicular to the second one or more surfaces.

The at least one guide protrusion may include a first guide protrusion and a second guide protrusion arranged to be spaced apart from each other along the first direction. The at least one guide recess may include a first guide recess and a second guide recess respectively corresponding to the first guide protrusion and the second guide protrusion. The first guide protrusion may be longer in length in the first direction than the second guide recess.

The image forming apparatus may further comprise a mounting guide and a guide frame. The mounting guide may protrude from an upstream portion of the cleaning device with respect to a mounting direction in which the cleaning device moves along the first direction when being mounted to the transfer unit The guide frame may be disposed to oppose the upstream portion of the cleaning device when the cleaning device is mounted to the transfer unit. The guide frame may include a position determination portion and a slanted portion slanted toward the position determination portion. The position determination portion may come in contact with the mounting guide when the cleaning device is mounted in its proper mounting position in relation to the transfer unit. The slanted portion may be arranged to guide the mounting guide to the position determination portion According to yet another aspect, an image forming apparatus may be provided to include an image carrier and a detachable cleaning device. The image carrier may be configured to carry thereon a developer image, an may have at least one rotational member configured to rotate about a rotational axis that extends along a first direction. The detachable cleaning device may be detachably supported in the image forming apparatus, and may include a cleaning member configured to come into contact with the image carrier so as to remove developer from the image carrier. The detachable cleaning device may be configured to move along the first direction and a second direction non-parallel to the first direction during mounting and dismounting of the detachable cleaning device to and from the image forming apparatus. The second direction may be the direction along which the cleaning member moves towards or away from the image carrier. The movement of the detachable cleaning device along the first direction may cause the detachable cleaning device to also move along the second direction.

The image forming apparatus may further comprise a guide mechanism that may be configured to guide the detachable cleaning device during mounting and dismounting of the detachable cleaning device to and from the image forming apparatus. The guide mechanism may comprise one or more protrusions spaced apart from each other and one or more recesses each corresponding to, and adapted to receive therein, the one of the one or more protrusions. The detachable cleaning device may be configured to move along the second direction toward the image carrier when each of the one or more protrusions is received in a corresponding one of the one or more recesses.

BRIEF DESCRIPTION OF THE DRAWINGS

Various aspects and advantages of the disclosure will become apparent and more readily appreciated from the following description of the embodiments, taken in conjunction with the accompanying drawings, in which.

DETAILED DESCRIPTION OF SEVERAL EMBODIMENTS

Figure 1:
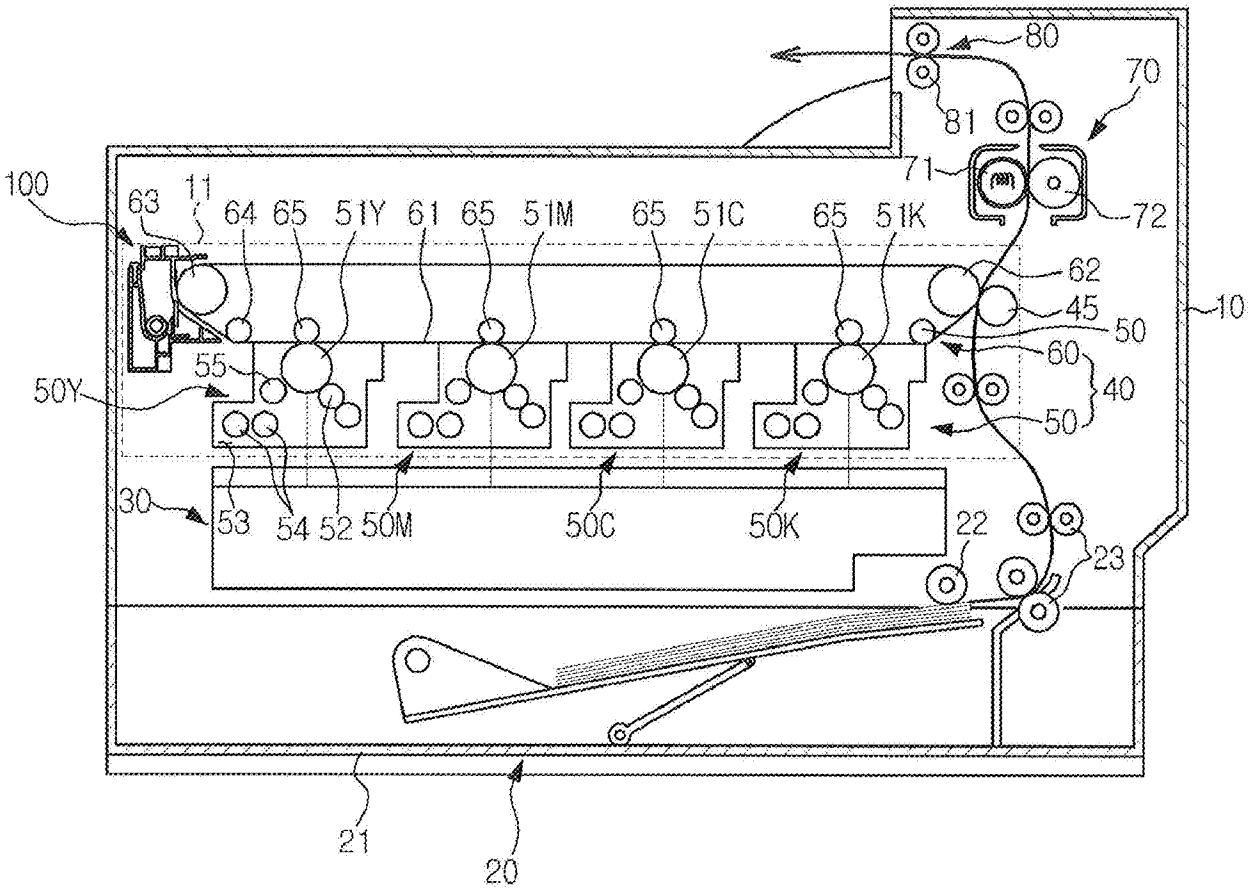
FIG. 1 is a view illustrating a constitution of an image forming apparatus according to an embodiment of the present disclosure.

Reference will now be made in detail to several embodiments of the present invention, examples of which are illustrated in the accompanying drawings, wherein like reference numerals refer to the like elements throughout.

FIG. 1 is a view illustrating a constitution of an image forming apparatus according to an embodiment of the present disclosure.

As shown in FIG. 1, an image forming apparatus 1 may comprise a main body 10, a printing medium feeding unit 20, a laser scanning unit 30, an image forming unit 40, a fusing unit 70 and a printing medium discharge unit 80.

The main body 10 defines the exterior appearance of the image forming apparatus 1, and may support therein various components. A cover 11 may be hingedly coupled to, or otherwise provided as capable of opening from, a surface of the main body 10 to provide an access to one or more components housed in the main body 10.

The printing medium feeding unit 20 may include a cassette 21 to store printing media S, a pickup roller 22 that picks up the printing medium S, e.g., a sheet at a time, and feeding rollers 23 that feed the picked-up printing medium toward the image forming unit 40.

The laser scanning unit 30 serves to irradiate light corresponding to image information to photosensitive bodies 51K, 51C, 51M and 51Y, to form electrostatic latent images on surfaces of the photosensitive bodies 51K, 51C, 51M and 51Y.

The image forming unit 40 may include a developing unit 50 that forms visible images by supplying developer, e.g., toner, to the electrostatic latent images formed on the photosensitive bodies 51K, 51C, 51M and 51Y, and a transfer unit 60 to transfer the visible images received from the photosensitive bodies 51K, 51C, 51M and 51Y to a printing medium.

The developing unit 50 may include four developing devices 50K, 50C, 50M and 50Y, in which developer of different color from each other, e.g., black (K), cyan (C), magenta (M) and yellow (Y), are respectively stored.

The respective developing devices 50K. 50C, 50M and 50Y may each include a charger 52 a developer storage part 53 developer conveying members 54 and a developing member 55. Prior to forming the electrostatic latent images on the photosensitive bodies 51K, 51C, 51M and 51Y, the respective chargers 52 charge the surfaces of the photosensitive bodies 51K, 51C, 51M and 51Y to a uniform potential level. The exposure to the light from the laser scanning unit 30 results in the formation of the electrostatic latent images on the uniformly charged surfaces of the photosensitive bodies 51K, 51C, 51M and 51Y. The developer stored in the developer storage parts 53 may be conveyed to the respective developing members 55 by the developer conveying members 54, which may then be in turn supplied by the developing members 55 to the electrostatic latent images on the photosensitive bodies 51K, 51C, 51M and 51Y, thereby forming visible developer images.

The transfer unit 60 may include a transfer belt 61, a driving roller 62, a supporting roller 63, tension rollers 64 and first transfer rollers 65. The transfer belt 61 rotates while being supported by the driving roller 62, the supporting roller 63 and the tension rollers 64. The transfer belt 61 serves as an image carrier which holds a developer image to be transferred onto a printing medium. In alternative embodiments, it is also possible that the developer images on the photosensitive bodies 51K, 51C, 51M and 51Y are transferred to the printing medium directly from the photosensitive bodies without the intermediary transfer to the transfer belt 61. In such embodiments, the printing medium may be guided to come into a direct contact with the photosensitive bodies 51K, 51C, 51M and 51Y.

The respective visible images formed on the photosensitive bodies 51K. 51C, 51M and 51Y are transferred onto the transfer belt 61 by the first transfer rollers 65, overlapping with each other. The image on the transfer belt 61 may be transferred onto the printing medium which is supplied from the printing medium feeding unit 20 as the printing medium passes between the second transfer roller 45 and the transfer belt 61.

The printing medium having passed through the transfer unit 60, and thus bearing a developer image thereon, may move to the fusing unit 70. The fusing unit 70 may include a heating roller 71 and a press roller 72. The image being carried on the printing medium becomes used to the printing medium by the application of the heat and pressure as the printing medium passes between the heating roller 71 and the press roller 72.

The printing medium passing through the fusing unit 70 is guided to the printing medium discharge unit 80, and then is discharged outside the main body 10 by a discharge roller 81.

When the image is transferred onto the printing medium, the developer on the transfer belt 61 may not completely transferred onto the printing medium, but some portion of the developer may remain on the transfer belt 61 after the transfer of the image onto the printing medium. The residual waste developer may be removed from the transfer belt 61 by a cleaning device 100.

Figure 2:
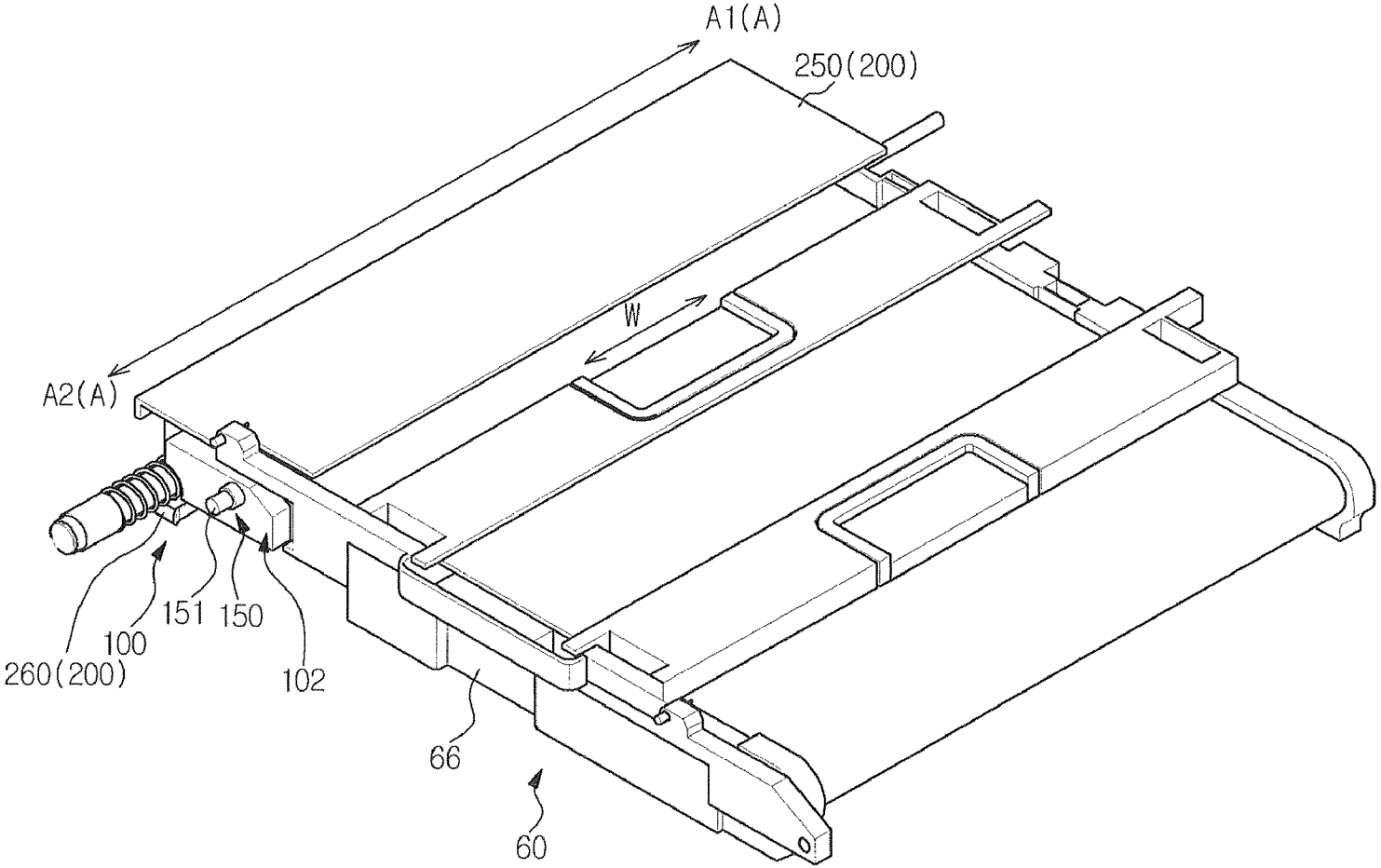
FIG. 2 is a perspective view illustrating a cleaning device mounted in a transfer unit of an image forming apparatus according to an embodiment of the present disclosure.
Figure 3:
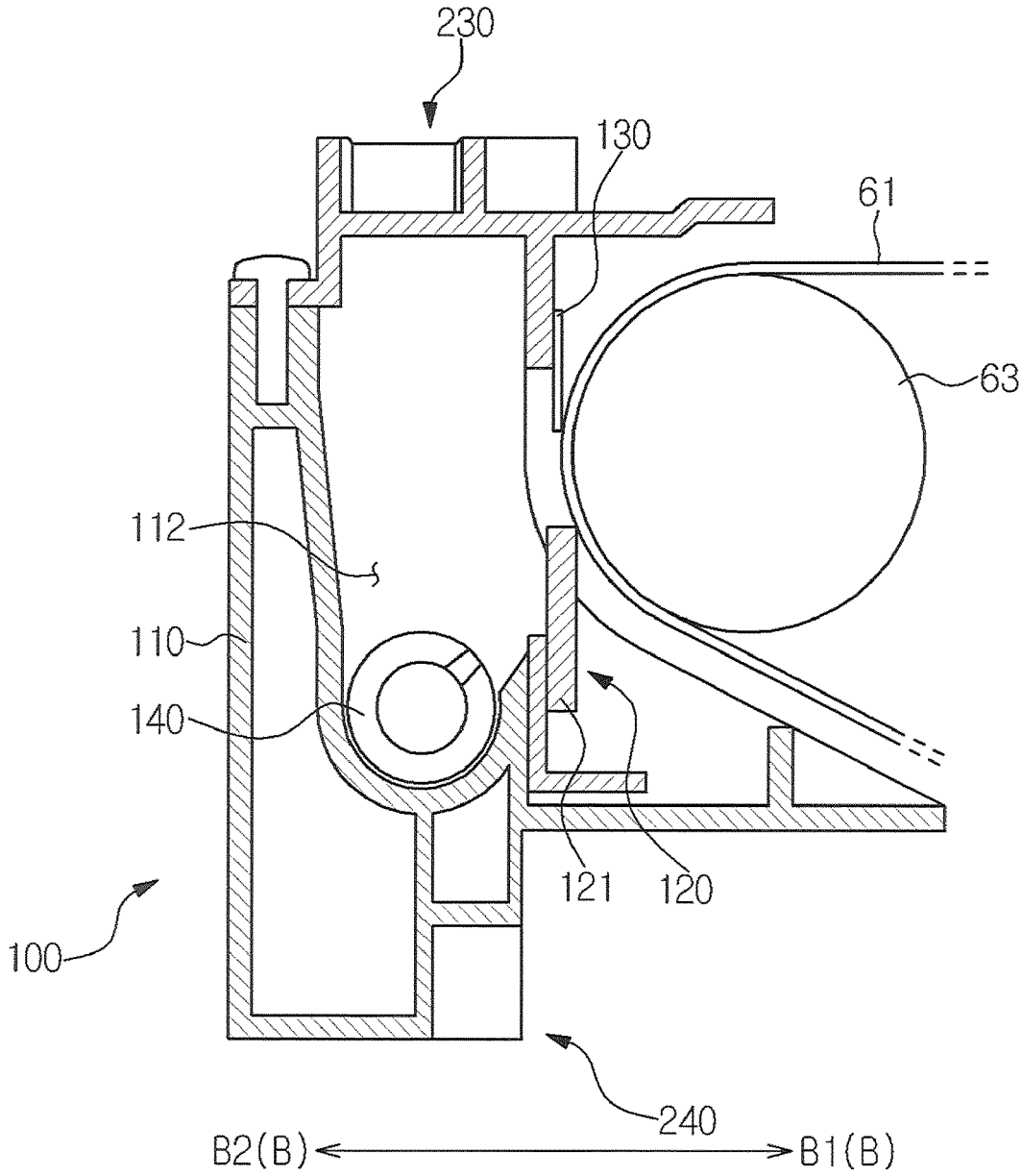
FIGS. 3 and 4 are sectional views illustrating respectively the mounted and dismounted states of the cleaning device according to an embodiment of the present disclosure.
Figure 4:
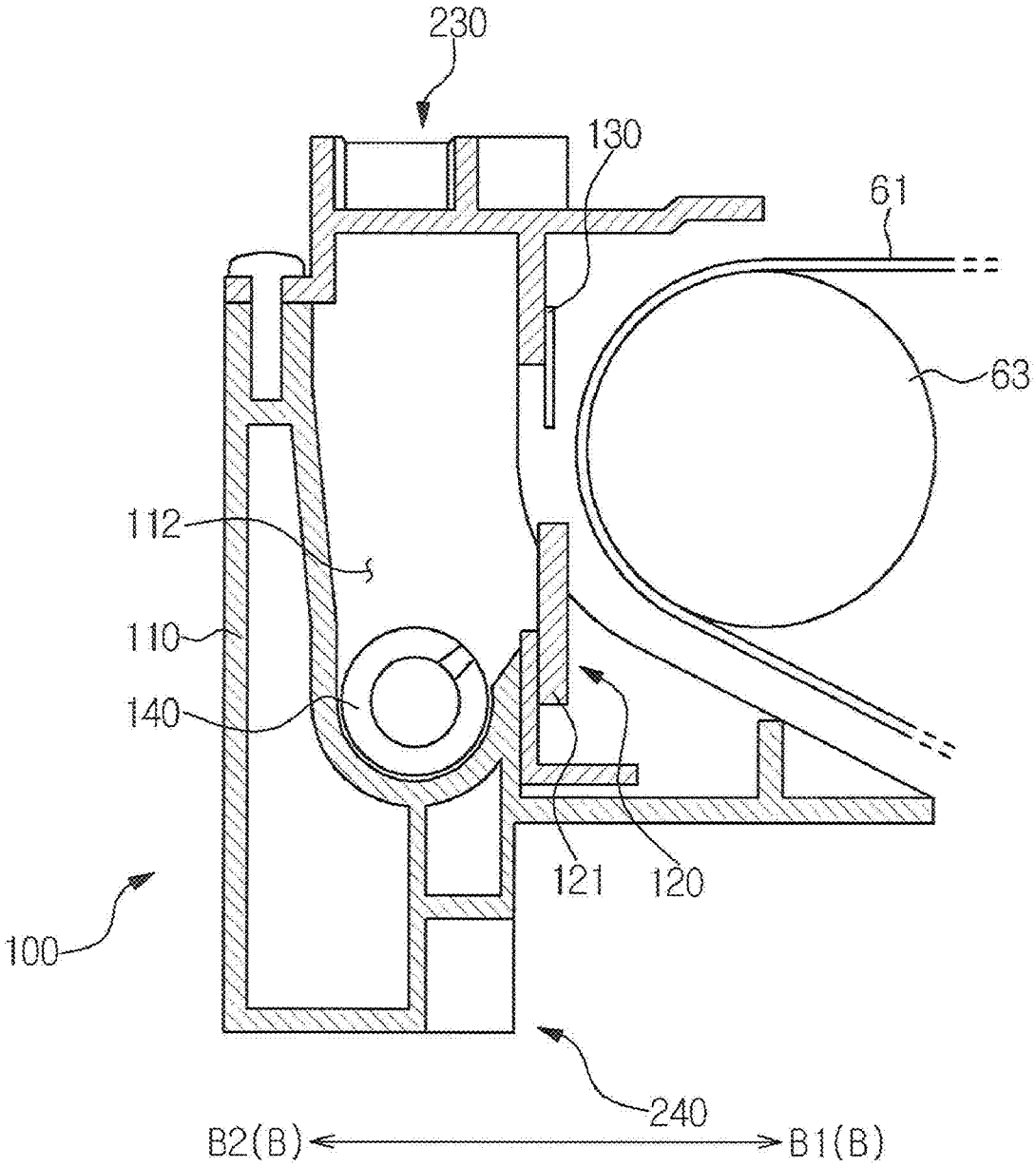

FIG. 2 is a perspective view illustrating a cleaning device mounted, by way of an example, to a transfer unit of an image forming apparatus according to an embodiment of the present disclosure. FIGS. 3 and 4 are sectional views illustrating the relevant portions of the cleaning device and the transfer unit shown in FIG. 2. FIG. 3 shows a state in which the cleaning device is mounted to the transfer unit, and in which the cleaning member is in contact with the transfer belt. FIG. 4 shows a state in which the cleaning member is separated from the transfer unit.

Referring to FIGS. 2 to 4, the transfer unit 60 may include a transfer unit frame 66. The cleaning device 100 may be detachably mounted to the transfer unit frame 66. Therefore, when the cleaning device 100 needs to be replaced or repaired, the cleaning device 100 can be removed from the transfer unit 60.

The image forming apparatus 1 according to an embodiment may include a first guide device 200 and a second guide device 300 (refer to FIGS. 7 and 10) to guide the mounting/dismounting of the cleaning device 100. During the mounting/dismounting operation of the cleaning device 100 to/from the transfer unit 60, the first guide device 200 guides the cleaning device 100 such that the cleaning device 100 can move while the separation between the cleaning member 120 of the cleaning device 100 and the transfer belt 61 may be maintained. For example, during the mounting operation of the cleaning device 100 to the transfer unit 60, the second guide device 300 guides the cleaning device 100 such that the cleaning member 120 comes into contact with the transfer belt 61 upon the completion of the mounting operation. The first guide device 200 and the second guide device 300 will be described in greater detail later.

Referring now to FIGS. 3 and 4, the cleaning device 100 may include a frame 110, a cleaning member 120, a shielding member 130 and a waste developer conveying member 140.

A waste developer storage part 112 may be provided inside the cleaning device frame 110. The cleaning member 120 and the shielding member 130 may be mounted in proximity to the waste developer storage part 112. According to an embodiment, the cleaning member 120 may be configured as a cleaning blade 121. The cleaning blade 121 has an end portion which makes a frictional contact with the transfer belt 61 so as to carry out a raking, or otherwise collection, of the residual developer from the surface of the transfer belt 61. The shielding member 130 is disposed to oppose the cleaning member 120 in the vertical direction, so as to prevent the waste developer from leaking out from the cleaning device 100.

The waste developer removed from the transfer belt 61 by the cleaning member 120 maybe stored in the waste developer storage part 112. The waste developer conveying member 140 may be mounted in the waste developer storage part 112, and may convey the waste developer stored in the waste developer storage part 112 to a waste developer discharge port 114 (refer to FIG. 6). The waste developer discharge port 114 may communicate with a waste toner container (not shown), which may be mounted inside the main body 10. According to an embodiment the waste developer discharged through the waste developer discharge port 114 may be stored in the waste toner container for subsequent disposal.

As shown in FIGS. 2 to 4, the cleaning device 100 is mounted or removed to/from the transfer unit 60 by moving in a first direction (A direction) and a second direction (B direction). The first direction A refers to a direction in which the cleaning device 100 moves along the width direction (W direction) of the transfer belt 61. The second direction B refers to the direction in which the cleaning member 120 moves towards or away from the transfer belt 61. Hereinafter, the first direction may taught to be further divided into a mounting direction and a removing direction, where the mounting direction is denoted as the A1 direction while the removing direction is denoted as the A2 direction as indicated in FIG. 2. The second direction may also be considered to include a contacting direction (i.e., the direction in which the cleaning member 120 moves towards the transfer belt 61) and a separating direction (i.e., the direction in which the cleaning member 120 moves away from the transfer belt 61). The contacting direction is denoted as the B1 direction while the separating direction is denoted as the B2 direction as shown in FIGS. 3 and 4.

Figure 5:
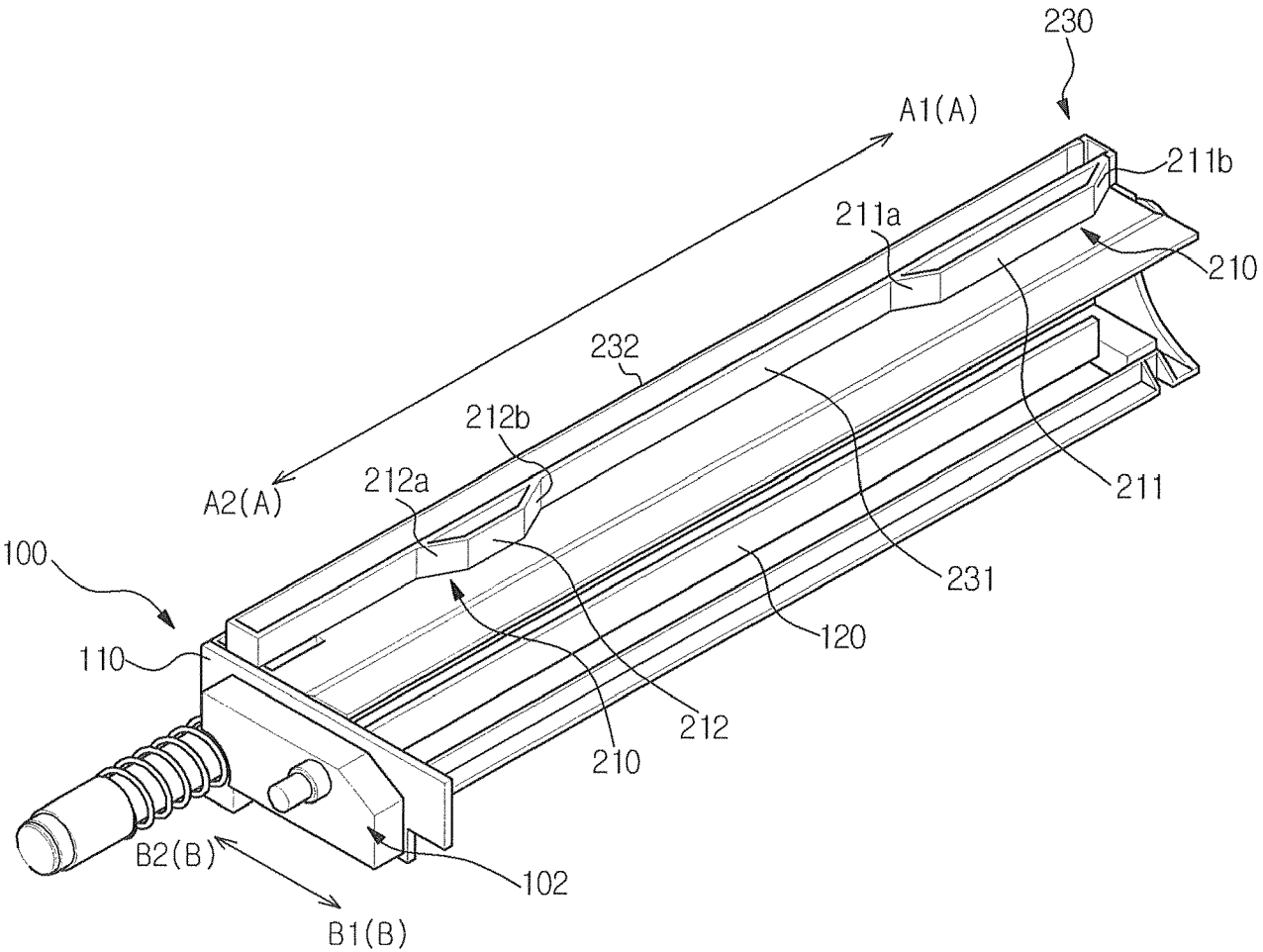
FIG. 5 is a perspective view illustrating a cleaning device in according to an embodiment of the present disclosure.
Figure 6:
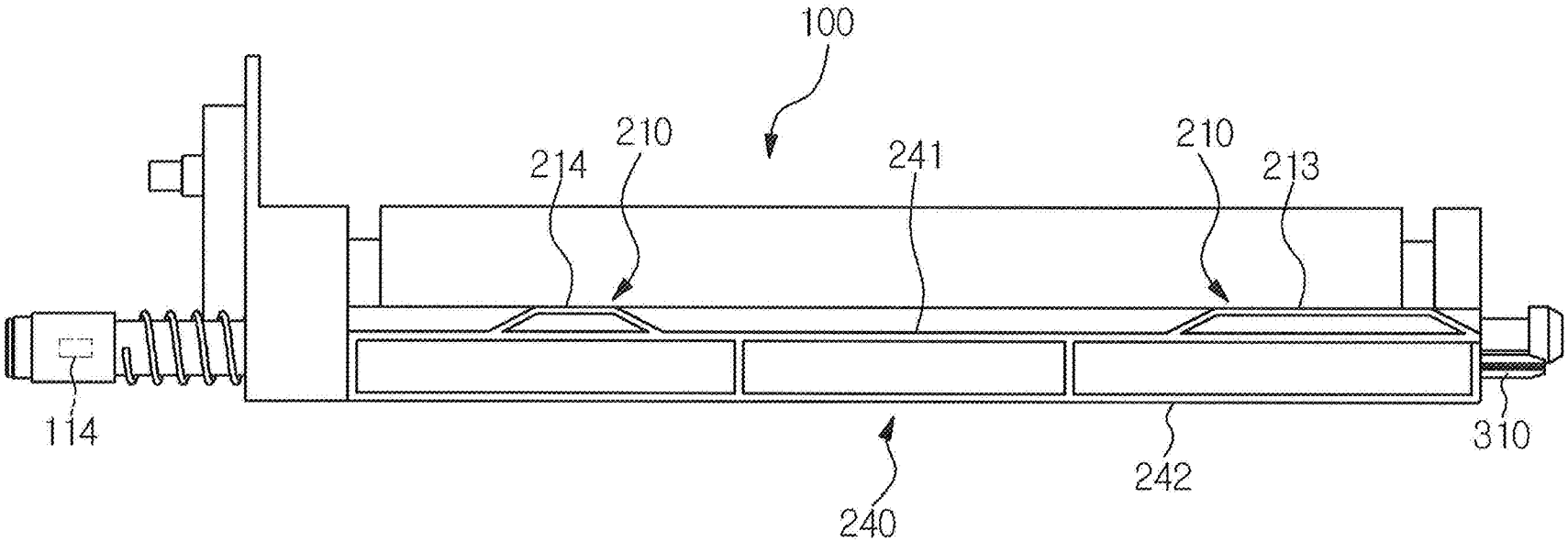
FIG. 6 is a bottom view of the cleaning device shown in FIG. 5.
Figure 7:
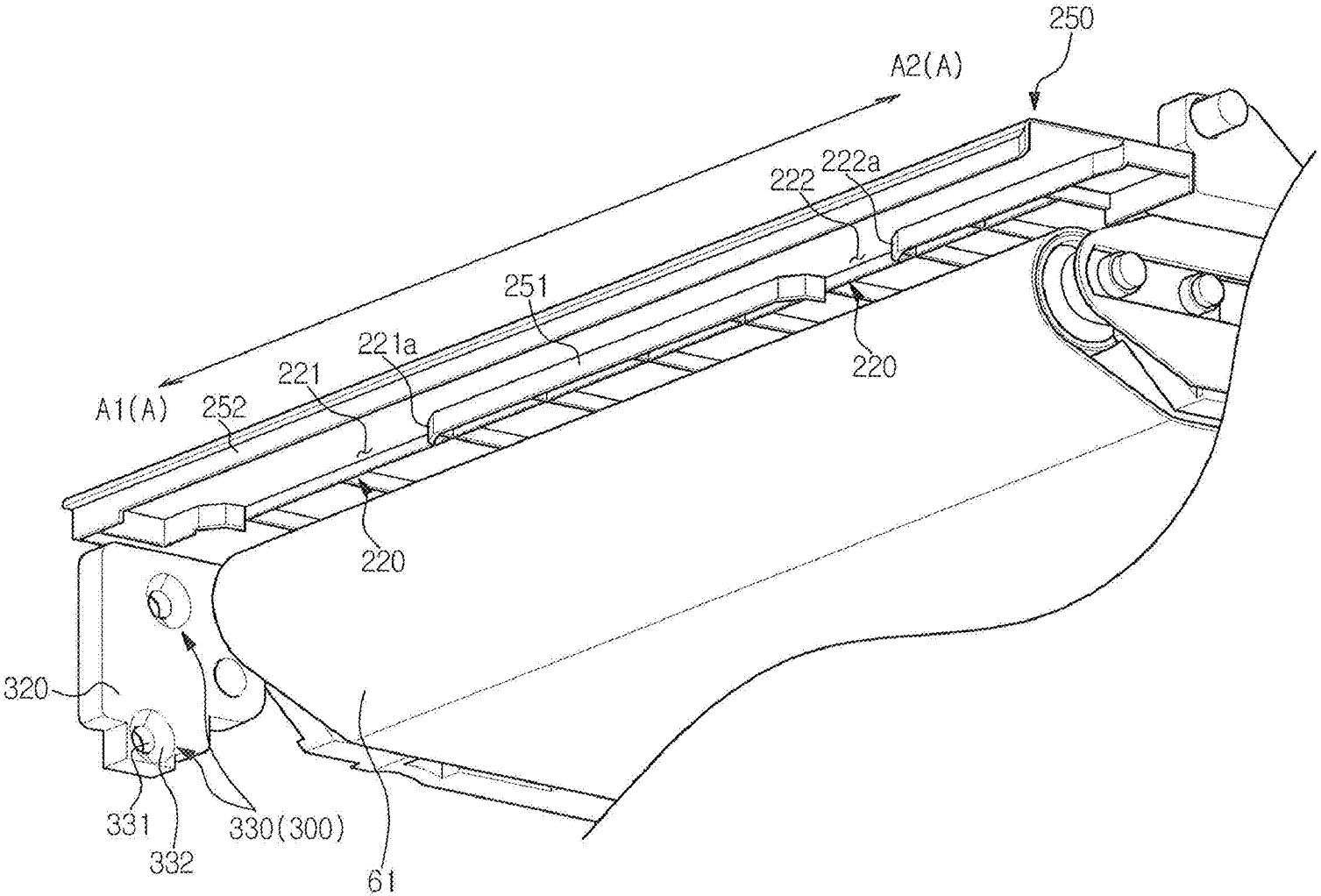
FIG. 7 is a perspective view illustrating a first guide rail and a guide frame in the image forming apparatus according to an embodiment of the present disclosure.
Figure 8:
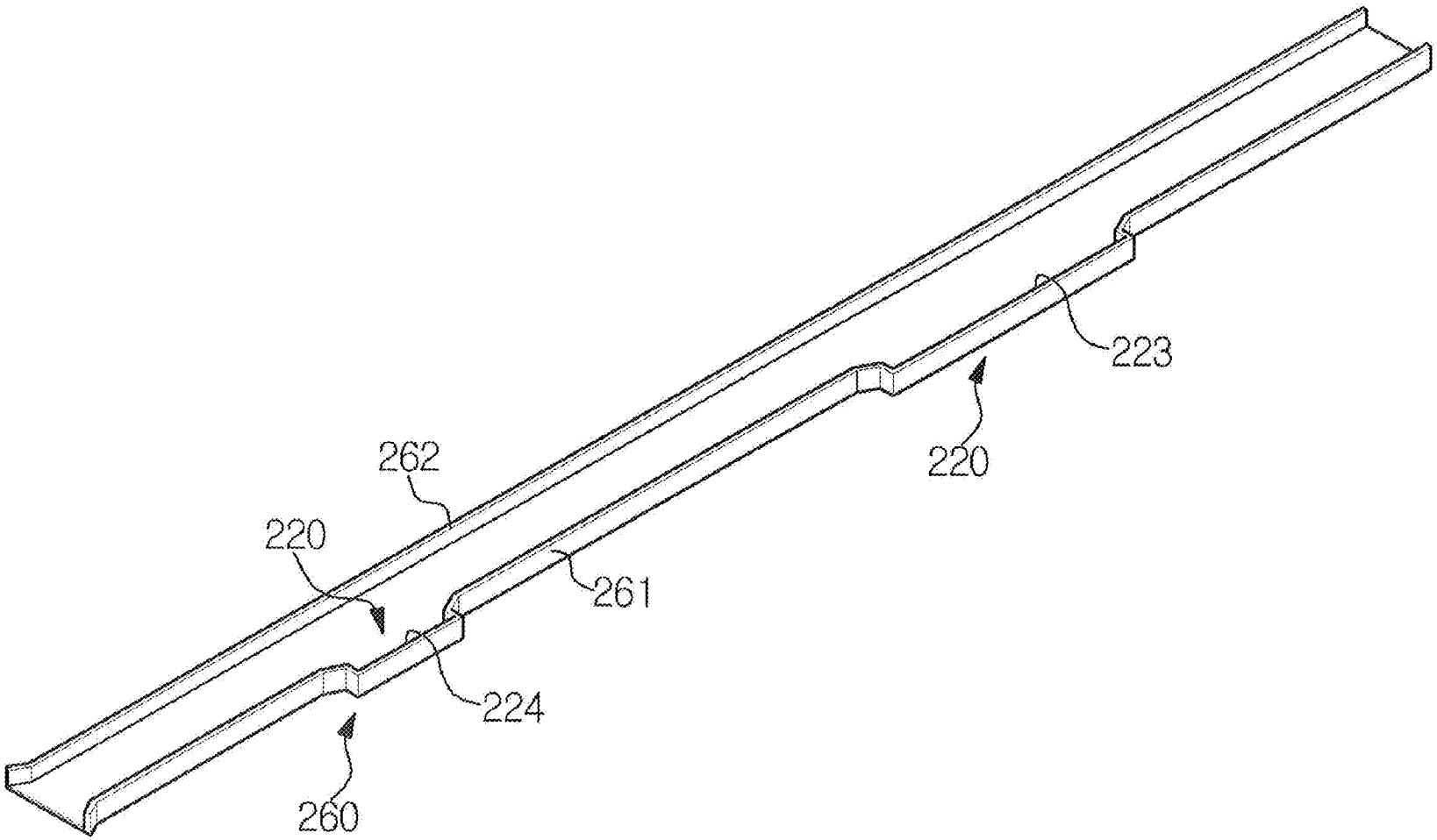
FIG. 8 is a perspective view illustrating a second guide rail in the image forming apparatus according to an embodiment of the present disclosure.
Figure 9:
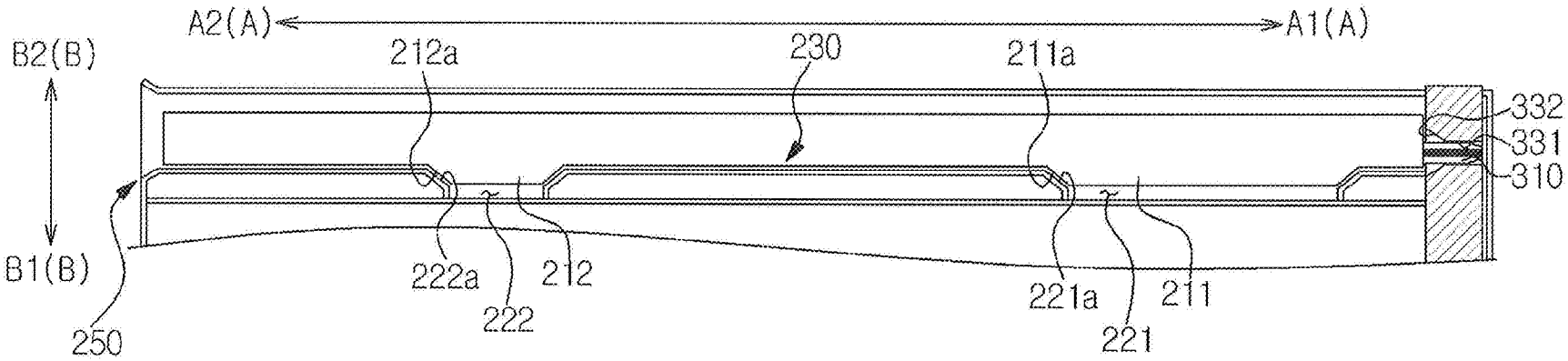
FIG. 9 is a view illustrating a first guide body, the first guide rail, a mounting guide and the guide frame in the image forming apparatus according to an embodiment of the present disclosure.

FIG. 5 is a perspective view illustrating a cleaning device according to an embodiment of the present disclosure. FIG. 6 is a bottom view of the cleaning device shown in FIG. 5. FIG. 7 is a perspective view illustrating a first guide rail and a guide frame, which may be provided in an image forming apparatus, according to an embodiment of the present disclosure. FIGS. 8 and 9 illustrate first guide rail, a second guide, a first guide body, the first guide rail, a mounting guide and the guide frame, one or more of which may be included in an image forming apparatus according to an embodiment of the present disclosure.

As shown in FIGS. 5 to 8, the first guide device 200 (refer to FIG. 2) may include a restraining unit(s) 210 (see FIG. 5) and a receiving unit(s) 220 (see FIG. 7). The restraining unit 210 restricts the movement of the cleaning device 100 in the second direction (B) when the cleaning device 100 moves in the first direction (A). The receiving unit(s) 220 receives the restraining unit(s) 210 so as to allow the cleaning device 100 to move in the second direction (B) to complete the mounting of the cleaning device 100.

Due to the restriction by the restraining unit 210 in the movement of the cleaning device 100 in the second direction, the cleaning device 100 may be moved along the first direction while maintaining a separation between the cleaning member 120 and the transfer belt 61. Accordingly, possible damages to the transfer belt 61 from the friction with the cleaning member 120 may be mitigated. The receiving unit(s) 220 releases the restraint by the restraining unit(s) 210 by receiving therein the restraining unit(s) 210 to allow the completion of the mounting of the cleaning device 100, and to allow the cleaning member 120 to come into a contact with the transfer belt 61.

The first guide device 200 may include first and second guide bodies 230 and 240 provided at the cleaning device 100, and first and second guide rails 250 and 260 provided corresponding to the first and second guide bodies 230 and 240. Although it has been described that this embodiment employs two guide bodies and two guide rails, the embodiment can be modified to employ any number of guide bodies and/or guide rails, for example, a single guide body with a single guide rail could also be used.

As shown in FIGS. 2, 7 and 8, the first guide body 230 may be provided on the top portion of the cleaning device frame 110 while the second guide body 240 may be provided on the bottom portion of the cleaning device frame 110. The first guide body 230 and the second guide body 240 may be formed integrally with the cleaning device frame 110, or may be formed as separate bodies that are coupled to the cleaning device frame 110.

The first guide rail 250 may correspond to, and be disposed above, the first guide body 230 to guide the first guide body 230 during the movement of the cleaning device 100. The second guide rail 260 may correspond to, and be disposed below, the second guide body 240 to guide the second guide body 240. According to an embodiment, the first guide rail 250 may be mounted, for example, to the transfer unit frame 66 while the second guide rail 260 is mounted to the main body 10. In alternative embodiments, each of the first guide rail 250 and the second guide rail 260 may be mounted to any of the transfer unit frame 66, the main body 10 or any other suitable structure within the main body 10.

Referring to FIGS. 5, 6 and 9, the first guide body 230 may include guide surfaces 231 and 232 extending along the first direction (A), and respectively opposing the two side walls 251 and 252 of the first guide rail 250. The two guide surfaces 231 and 232 of the first guide body 230 are configured to be able to be disposed between the two side walls 251 and 252 of the first guide rail 250.

In the embodiment depicted in FIGS. 5-9, by way of an illustrative example, two restraining units 210 are provided, each including a guide protrusion, such as, for example, a first guide protrusion 211 and a second guide protrusion 212, respectively, as illustrated in the figures. The first guide protrusion 211 and the second guide protrusion 212 protrude in the second direction toward the side wall 251 from the guide surface 231 of the first guide body 230, which is disposed nearer to the transfer belt 61 than the guide surface 232. The receiving units 220, according to the illustrated embodiment, may include a first guide recess 221 and a second guide recess 222 formed on the side wall 251 of the first guide rail 250. The first guide recess 221 and the second guide recess 222 are arranged to be capable of receiving the first guide protrusion 211 and the second guide protrusion 212, respectively.

While the cleaning device 100 moves in the first direction, the first guide protrusion 211 and the second guide protrusion 212 guide the position of the cleaning device 100 such that the cleaning member 120 does not contact the transfer belt 61. When the cleaning device 100 is positioned at the proper mounting position with respect to the first direction CA), the first guide recess 221 and the second guide recess 222 receive the first guide protrusion 211 and the second guide protrusion 212, respectively, to complete the process of mounting the cleaning device 100 in the image forming apparatus.

The first guide protrusion 211 and the second guide protrusion 212 may have different lengths from each other with respect to the first direction. The first guide recess 221 and the second guide recess 222 may have different lengths from each other in the first direction, correspondingly respectively to the first guide protrusion 211 and the second guide protrusion 212.

With the unequal lengths configuration described above, for example, if the first guide protrusion 211 is longer than the second guide recess 222 in the first direction, during the movement of the cleaning device 100 in the A1 direction during mounting, the first guide protrusion 211 can be prevented from being seated in the second guide recess 122.

The first guide protrusion 211 and the second guide protrusion 212 may have first slanted surfaces 211*a* and 212*a* which are slanted from the guide surface 231. The first guide recess 221 and the second guide recess 222 may have second slanted surfaces 221*a* and 222*a* corresponding to the first slanted surfaces 211 a and 212*a*. When the cleaning device 100 moves in the A2 direction, the first slanted surfaces 211 a and 212*a* and the second slanted surfaces 221 a and 222*a* serve to provide a smooth exit by the first guide protrusion 211 and the second guide protrusion 212 from the first guide recess 221 and the second guide recess 222.

The first guide protrusion 211 and the second guide protrusion 212 have third slanted surfaces 211*b* and 212*b* positioned opposite to the first slanted surfaces 211*a* and 212*a* in the first direction. The third slanted surfaces 211*b* and 212*b* serve to guide the first guide protrusion 211 and the second guide protrusion 212 to move smoothly along the first guide rail 250.

As shown in FIGS. 6 and 8, similar to the first guide body 230, the second guide body 240 may have guide surfaces 241 and 242, a first guide protrusion 213 and a second guide protrusion 214. Similar to the first guide rail 250, the second guide rail 260 may have side walls 261 and 262, a first guide recess 223 and a second guide recess 224. Since the constitution of the second guide body 240 and the second guide rail 260 can be easily understood from the constitution of the first guide body 230 and the first guide rail 250, the same explanation will not be repeated.

Figure 10:
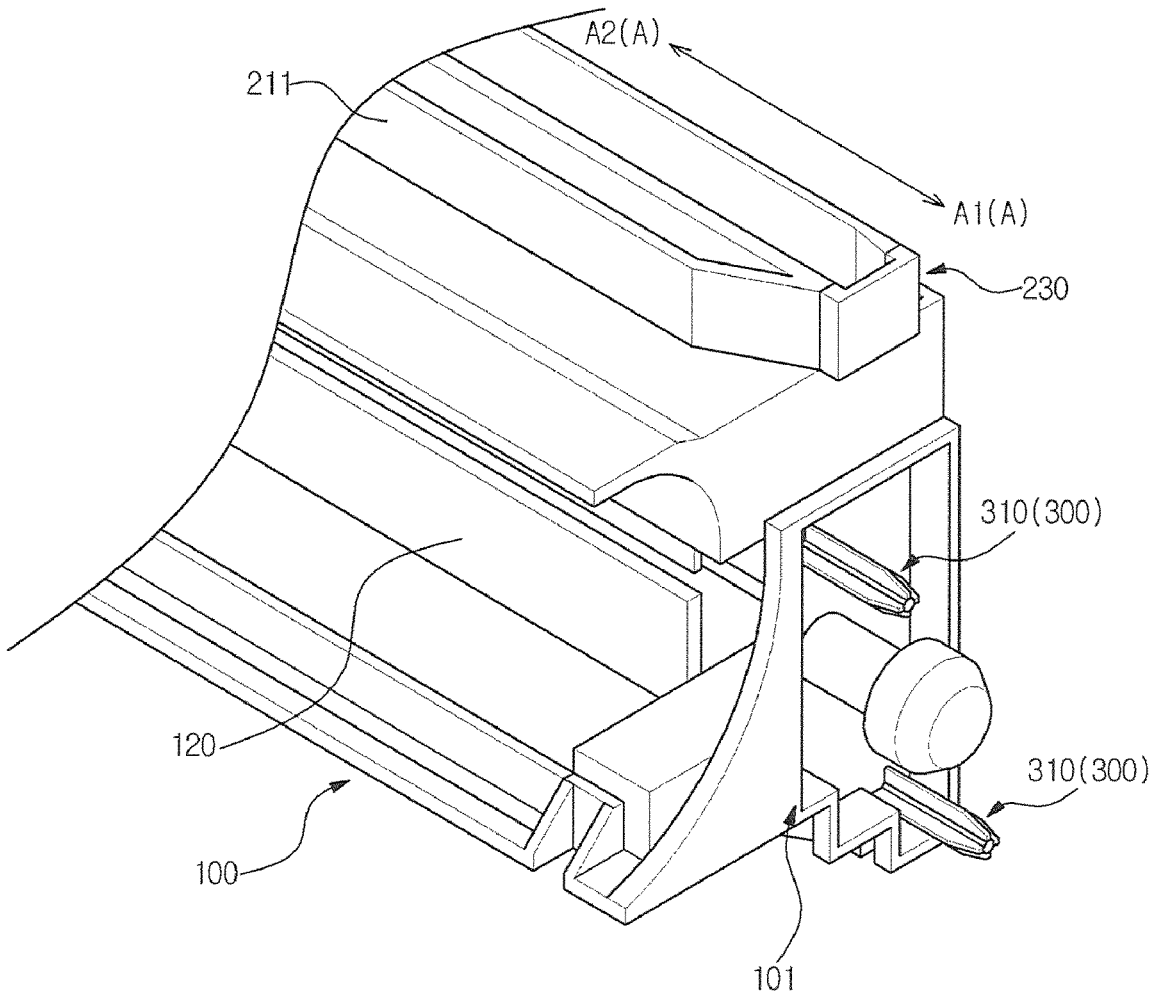
FIG. 10 is a perspective view illustrating a mounting guide in the image forming apparatus according to an embodiment of the present disclosure.

FIG. 10 is a perspective view illustrating a mounting guide in an image forming apparatus according to an embodiment of the present disclosure.

Referring now to FIGS. 7, 9 and 10, the image forming apparatus 1 may include a second guide device 300 for guiding the cleaning device 100 in the second direction during the mounting/dismounting of the cleaning device 100.

The second guide device 300 may include a mounting guide(s) 310, which may be formed at the front end portion 101 of the cleaning device 100 in the mounting direction (A1 direction) of the cleaning device 100, and a guide frame 320 (see FIG. 7) disposed to face the mounting guide(s) 310.

The mounting guide(s) 310 may extend from the front end portion 101 of the cleaning device 100 along the first direction. When the cleaning device 100 reaches the proper mounting position, the mounting guide(s) 310 may become coupled to the guide channel(s) 330 formed on the guide frame 320.

When the mounting of the cleaning device 100 in the first direction is completed, the guide channel 330 receives the mounting guide 310 as the cleaning device 100 moves in the second direction, and thereby determines the mounting position of the cleaning device 100. The guide channel 330 may include a position determination portion 331 and a slanted portion 332. The position determination portion 331 is coupled to the mounting guide 310 to determine the mounting position of the cleaning device 100. The slanted portion 332 is slanted toward the position determination portion 331 to guide the mounting guide 310 to the position determination portion 331.

As shown in FIG. 2, a fixing unit 150 may be provided at the rear end portion 102 with respect to the mounting direction (A1 direction) of the cleaning device 100, so as to fix the cleaning device 100 to the transfer unit 60. The fixing unit 150 may include a head part 151 and a fixing part (not shown) extending from the head part 151 toward the transfer unit 60. The fixing part may be formed to be screw-engaged with the transfer unit frame 66, for example.

Hereinafter, the mounting/dismounting operation of the cleaning device 100 will be described with reference to FIGS. 11 and 12, with reference primarily to the first guide body 230 and the first guide rail 250. It should be understood that the second guide body 240 and the second guide rail 260 behave in substantially the same manner during the mounting/dismounting operation of the cleaning device 100.

The removing operation of the cleaning device 100 will firstly be explained with reference to FIGS. 2, 9 and 11. As shown in FIGS. 2 and 9, from the state that the cleaning device 100 is mounted in the transfer unit 60, the engagement between the fixing unit 150 and the transfer unit 60 may be released by, for example, rotating the head part 151 of the fixing unit 150. Thereafter, the cleaning device 100 may be pulled, so that the cleaning device 100 moves in the A2 direction, and become separated from the transfer unit 60.

Figure 11:
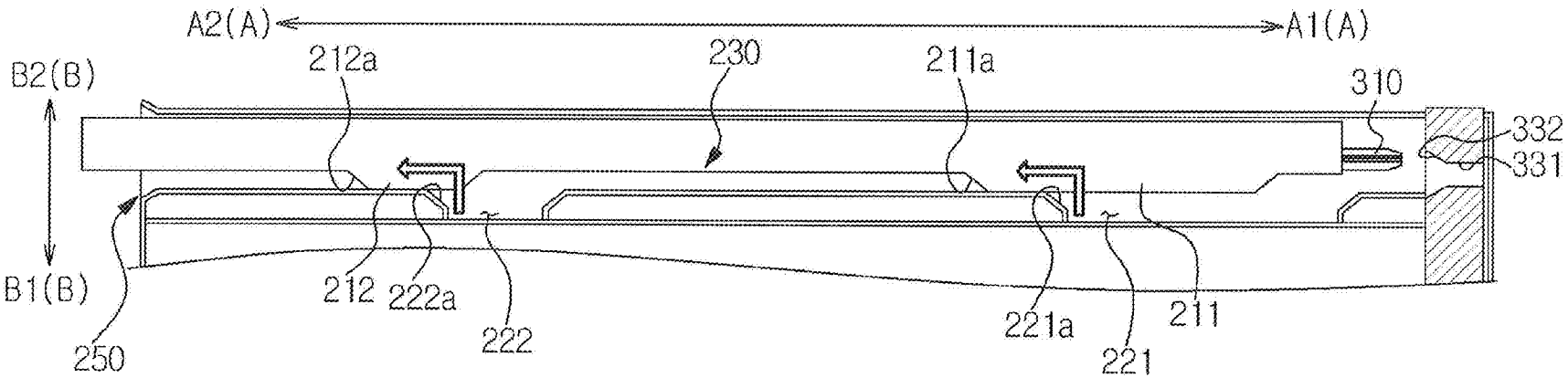
FIGS. 11 and 12 are views illustrating cleaning device mounting/dismounting operations in the image forming apparatus according to an embodiment of the present disclosure.
Figure 12:
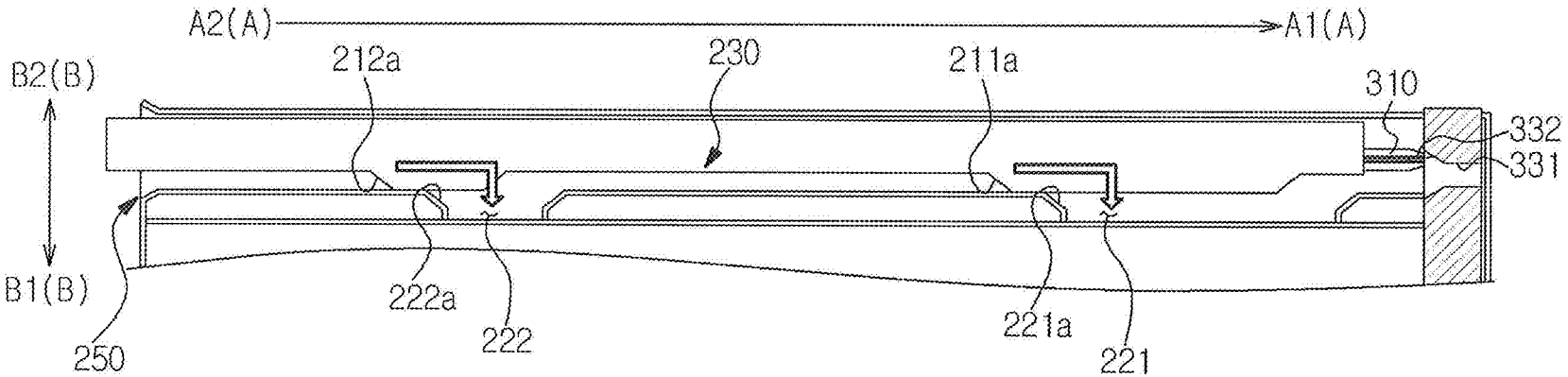

When the cleaning device 100 starts to move in the A2 direction, as shown in FIG. 11, the first guide protrusion 211 and the second guide protrusion 212 of the first guide body 230 escape from the first guide recess 221 and the second guide recess 222. At this time, the first slanted surfaces 211*a* and 212*a* of the first and second guide protrusions 211 and 212 and the second slanted surfaces 221*a* and 222*a* of the first and second guide recesses 221 and 222 assist the first and second guide protrusions 211 and 212 moving out of the first and second guide recesses 221 and 222. While the first and second guide protrusions 211 and 212 escape from the first and second guide recesses 221 and 222, the cleaning device 100 moves in the B2 direction. Accordingly, as shown in FIG. 4, the cleaning member 120 of the cleaning device 100 is separated from the transfer belt 61. In such a state, the cleaning device 100 is farther pulled in the A2 direction, and is thereby separated from the transfer unit 60.

The embodiments described above may advantageously allow both the separation of the cleaning member 120 from the transfer belt 61 and the removal of the cleaning device 100 from the transfer unit 60 by the same pulling of the cleaning device 100 in the A2 direction.

The mounting operation of the cleaning device 100 will now be explained with reference to FIG. 12. If a user pushes the cleaning device 100 in the A1 direction, the cleaning device 100 moves along the A1 direction to be mounted in the transfer unit 60. When the cleaning device 100 moves in the A1 direction, the first and second guide protrusions 211 and 212 of the first guide body 230 restricts the movement of the cleaning device 100 in the B1 direction, thus maintaining the separation between the cleaning member 120 and the transfer belt 61 as shown in FIG. 4.

When the cleaning device 100 reaches the mounting position with respect to the first direction, the first and second guide protrusions 211 and 212 of the first guide body 230 are positioned to correspondingly oppose the first and second guide recesses 221 and 222 of the first guide rail 250. In such position, the cleaning device 100 is able to move in the B1 direction.

As the mounting guide 310 of the second guide device 300 are received into the guide channel 330 of the guide frame 320, the slanted portion 332 of the guide channel 330 guides the mounting guide 310 so that the cleaning device 100 moves in the B1 direction. As the cleaning device 100 moves in the B1 direction, the first and second guide protrusions 211 and 212 are received in the first and second guide recesses 221 and 222, and the cleaning member 120 of the cleaning device 100 comes into contact with the transfer belt 61.

When the mounting guide 310 engages the position determination portion 331 of the guide channel 330, as shown in FIG. 9, the mounting of the cleaning device 100 is completed. In such a state, the cleaning device 100 may be fixed to the transfer unit 60 by using the fixing unit 150.

According to an aspect of the present disclosure, several embodiments described above have the advantage of enabling the mounting of the cleaning device 100 and the positioning of the cleaning member 120 in relation to the transfer belt 61 may both be achieved only with the single pushing of the cleaning device 100 in the A1 direction.

Although several embodiments were described as employing two guide protrusions and two guide recesses, it should be readily apparent that the number of guide protrusions and guide recesses are not limiting, and that, in alternative embodiments, any number of guide protrusions and guide recesses, one or three or more of guide protrusions and/or guide recesses may be employed.

Although it has been described that the guide protrusions are provided at the guide body of the cleaning device and the guide recesses are formed at the guide rail, it should be readily understood that the opposite arrangement is also possible, that is, for example, the guide protrusions can be provided at the guide rail and the guide recesses can be formed at the guide body of the cleaning device.

As is apparent from the above disclosure, according to an aspect thereof, an image forming apparatus may be provided to include a structure capable of allowing convenient mounting or dismounting of the cleaning device, which reduces the likelihood of damage to the image carrier, which may result from the contact with the cleaning member of the cleaning device during the cleaning device mounting/dismounting.

Although several embodiments of the present disclosure have been shown and described, it would be appreciated by those skilled in the art that changes may be made in these embodiments without departing from the principles and spirit of the inventive aspects of the present disclosure, the scope of which is defined in the claims and their equivalents.

What is claimed is:

1. An image forming apparatus, comprising:

an image carrier having a surface on which a quantity of developer is carried;

a detachable cleaning device detachably supported in the image forming apparatus, the detachable cleaning device including a cleaning member configured to come into contact with the surface of the image carrier so as to remove developer from the surface of the image carrier, the detachable cleaning device being configured to move along a first direction and a second direction non-parallel to the first direction during mounting and dismounting of the detachable cleaning device to and from the image forming apparatus, the second direction being a direction along which the cleaning member moves toward or away from the surface of the image carrier; and a first guide including a restraining portion and a receiving portion, the restraining portion being configured to limit a movement of the detachable cleaning device along the second direction toward the surface of the image carrier when the detachable cleaning device moves along the first direction, the receiving portion being configured to receive the restraining portion so as to allow the detachable cleaning device to move in the second direction, the restraining portion and the receiving portion being adapted to cooperate together such that the movement of the detachable cleaning device along the first direction initiates the movement of the detachable cleaning device along the second direction.

2. The image forming apparatus according to claim 1, further comprising a second guide configured to guide the detachable cleaning device to move along the second direction toward the surface of the image carrier so as to bring the cleaning member into contact with the surface of the image carrier.

3. The image forming apparatus according to claim 2, wherein the second guide includes at least one mounting guide protruding from a front end portion of the detachable cleaning device along the first direction.

4. The image forming apparatus according to claim 3, wherein the second guide further includes a guide frame disposed to oppose the front end portion of the detachable cleaning device when the detachable cleaning device is mounted in the image forming apparatus, and wherein the guide frame includes at least one guide channel to receive the at least one mounting guide in such a manner to guide the detachable cleaning device to move along the second direction.

5. The image forming apparatus according to claim 4, wherein the at least one guide channel each includes a position determination portion and a slanted portion slanted toward the position determination portion, and wherein the position determination portion is in contact with a corresponding one of the at least one mounting guide when the detachable cleaning device is mounted in its proper mounting position within the image forming apparatus, the slanted portion being arranged to guide the mounting guide to the position determination portion.

6. The image forming apparatus according to claim 1, wherein the first guide further includes at least one guide body provided at the detachable cleaning device and at least one guide rail, the at least one guide body each having a guide surface extending along the first direction, the at least one guide rail each having a side wall opposing the guide surface.

7. The image forming apparatus according to claim 6, wherein the first guide further comprises at least one guide protrusion protruding along the second direction from any first ones of the guide surface and the side walls.

8. The image forming apparatus according to claim 7, wherein the first guide further comprises at least one guide recess formed on a second ones of the guide surfaces and the side walls opposing the first ones of the guide surfaces and the side walls, the at least one guide recess being configured to receive therein a respective corresponding one of the at least one guide protrusion.

9. The image forming apparatus according to claim 8, wherein at least one of the at least one guide protrusion and the at least one guide recess includes a slanted surface slanted with respect to the first direction, the slanted surface promoting the movement of the detachable cleaning device along the second direction.

10. The image forming apparatus according to claim 8, wherein the at least one guide protrusion includes a first guide protrusion and a second guide protrusion, the second guide protrusion being located downstream of the first guide protrusion with respect to a mounting direction of the detachable cleaning device along the first direction, the mounting direction being a direction in which the detachable cleaning device moves while being mounted in the image forming apparatus, wherein the at least one guide recess includes a first guide recess and a second guide recess respectively corresponding to the first guide protrusion and the second guide protrusion, and wherein the first guide protrusion being longer in length with respect to the first direction than the second guide recess.

11. The image forming apparatus according to claim 7, wherein the at least one guide protrusion includes a first guide protrusion and a second guide protrusion, the first guide protrusion being arranged to be spaced apart from the second guide protrusion, and being longer in length with respect to the first direction than the second guide protrusion.

12. The image forming apparatus according to claim 6, wherein the at least one guide body includes a first guide body provided on a top portion of the detachable cleaning device and a second guide body provided on a bottom portion of the detachable cleaning device, and wherein the at least one guide rail includes a first guide rail and a second guide rail respectively corresponding to the first guide body and the second guide body.

13. The image forming apparatus according to claim 1, further comprising a fixing unit to securely fix the detachable cleaning device to its proper mounting position within the image forming apparatus.

14. An image forming apparatus, comprising:

a transfer unit including a transfer belt configured to transfer developer onto a printing medium;

a cleaning device removably mounted to the transfer unit, the cleaning device being movable along a first direction in relation to the transfer unit;

at least one guide body provided at the cleaning device, the guide body having a side surface extending along the first direction;

at least one guide rail having a side wall extending along the first direction and opposing the side surface of a corresponding one of the at least one guide body;

at least one guide protrusion protruding from a first one or more surfaces selected from any of the side surfaces of the at least one guide body and any of the side walls of the at least one guide rail; and at least one guide recess formed on a second one or more surfaces that oppose the first one or more surfaces, the at least one guide recess adapted to receive a corresponding one of the at least one guide protrusion.

15. The image forming apparatus according to claim 14, wherein the at least one guide protrusion each includes a slanted surface non-parallel and non-perpendicular to the first one or more surfaces.

16. The image forming apparatus according to claim 14, wherein the guide recess includes a slanted surface non-parallel and non-perpendicular to the second one or more surfaces.

17. The image forming apparatus according to claim 14, wherein the at least one guide protrusion includes a first guide protrusion and a second guide protrusion arranged to be spaced apart from each other along the first direction, wherein the at least one guide recess includes a first guide recess and a second guide recess respectively corresponding to the first guide protrusion and the second guide protrusion, and wherein the first guide protrusion is longer in length in the first direction than the second guide recess.

18. The image forming apparatus according to claim 14, further comprising a mounting guide and a guide frame, the mounting guide protruding from an upstream portion of the cleaning device with respect to a mounting direction in which the cleaning device moves along the first direction when being mounted to the transfer unit, the guide frame being disposed to oppose the upstream portion of the cleaning device when the cleaning device is mounted to the transfer unit, wherein the guide frame includes a position determination portion and a slanted portion slanted toward the position determination portion, and wherein the position determination portion comes in contact with the mounting guide when the cleaning device is mounted in its proper mounting position in relation to the transfer unit, the slanted portion being arranged to guide the mounting guide to the position determination portion.

19. An image forming apparatus, comprising:

an image carrier configured to carry thereon a developer image, the image carrier having at least one rotational member configured to rotate about a rotational axis that extends along a first direction; and a detachable cleaning device detachably supported in the image forming apparatus, the detachable cleaning device including a cleaning member configured to come into contact with the image carrier so as to remove developer from the image carrier, the detachable cleaning device being configured to move along the first direction and a second direction non-parallel to the first direction during mounting and dismounting of the detachable cleaning device to and from the image forming apparatus, the second direction being a direction along which the cleaning member moves towards or away from the image carrier, a movement of the detachable cleaning device along the first direction causing the detachable cleaning device to also move along the second direction.

20. The image forming apparatus according to claim 19, further comprising:

a guide mechanism configured to guide the detachable cleaning device during mounting and dismounting of the detachable cleaning device to and from the image forming apparatus, the guide mechanism comprising:

one or more protrusions spaced apart from each other; and one or more recesses each corresponding to, and adapted to receive therein, the one of the one or more protrusions, the detachable cleaning device being configured to move along the second direction toward the image carrier when each of the one or more protrusions is received in a corresponding one of the one or more recesses.

* * * * *